US006672471B2

(12) United States Patent
Cross

(10) Patent No.: US 6,672,471 B2
(45) Date of Patent: Jan. 6, 2004

(54) TABLET BOX CONSTRUCTION

(76) Inventor: Harley Cross, 99 Park Ave., New York, NY (US) 10016-1503

( * ) Notice: Subject to any disclaimer, the term of this patent is extended or adjusted under 35 U.S.C. 154(b) by 0 days.

(21) Appl. No.: 09/895,587

(22) Filed: Jul. 2, 2001

(65) Prior Publication Data

US 2002/0139802 A1 Oct. 3, 2002

Related U.S. Application Data

(60) Provisional application No. 60/280,127, filed on Apr. 2, 2001.

(51) Int. Cl.[7] ..... B65D 43/20; B65D 43/12

(52) U.S. Cl. ..... 220/345.4; 220/345.2; 206/38; 206/267

(58) Field of Search ..... 220/345.2, 345.4, 220/351; 206/38, 267, 37; 229/125.12; 384/23

(56) References Cited

U.S. PATENT DOCUMENTS 2,309,111 A * 1/1943 Hothersall ..... 220/345.4
3,049,224 A * 8/1962 Fredette et al. ..... 206/532
3,586,394 A * 6/1971 Hecksel ..... 384/23
3,833,143 A * 9/1974 Starkermann et al. ..... 220/345
4,057,166 A * 11/1977 Yamazaki et al. ..... 220/345 X
4,420,079 A * 12/1983 Gliniiorz et al. ..... 206/387
4,817,819 A * 4/1989 Kelly ..... 206/531 X
5,275,291 A * 1/1994 Sledge ..... 206/531
5,353,947 A * 10/1994 Zinnbauer et al. ..... 220/331

* cited by examiner

*Primary Examiner*—Tri M. Mai
(74) *Attorney, Agent, or Firm*—Charles E. Temko

(57) ABSTRACT

A two-piece container for mints or similar tablet type contents in which base and cover elements are arranged for relative sliding movement in opened and closed condition and are of curvate configuration so as to approximately conform to the figure of a user when the device is disposed in a side pocket of a jacket or similar garment. The cover element is configured such that the upper surface and the lower surface of the base element are exposed for contact between the thumb and fingers of a user, thus permitting the opening and closing of the container using the thumb and fingers of a single hand.

1 Claim, 1 Drawing Sheet

TABLET BOX CONSTRUCTION

RELATED APPLICATION

Reference is made to my copending provisional patent application, Serial No. 60/280,127, filed Apr. 2, 2001, under the title Tablet Box Construction, to which a claim of priority is made.

BACKGROUND OF THE INVENTION

This invention relates generally to the field of small containers, and more particularly to a container for mints and the like of a type wherein a base element is arranged for sliding movement relative to a cover element, as contrasted with a more common hinge-type construction. Containers of this general type are known in the art, and are typically employed as boxes for wooden matches and similar articles.

Where the containers are of relatively small dimensions, they can be carried in a jacket pocket of a wearer without distorting the appearance of the garment when worn. Where the container is of large dimensions, typically over three inches in both length and width, and of planar configuration, they cannot be carried in a garment pocket without noticeable bulging of the pocket to result in undesirable appearance, regardless of whether the garment is in buttoned condition.

Another problem which exists with hinged construction is that it is difficult to open using the fingers of a single hand of the user. If the user is standing or sitting on an unstable support, such as a moving vehicle, the opening of a hinge type container exposes all of the contents of rather than only that part adjacent an edge, and thus the likelihood of spillage of the entire contents is significantly increased.

SUMMARY OF THE INVENTION

Briefly stated, the invention contemplates the provision of an improved container construction of the class described including a base element and a cover element, each of corresponding curvature, the elements being slidably engaged for relative movement between opened and closed positions. Detent means is provided for retaining the elements in closed condition. Additional detent means is provided for preventing mutual disengagement when the container is at a limit of opening movement.

Because of the construction of the cover element, a lower surface of the base element is exposed for frictional contact of the fingers of the user, while the upper surface of the cover element is contacted by the thumb, whereby mutual movement of the thumb and fingers may result in only partial opening of the cover element relative to the base element, so that one or more tablets adjacent an exposed end edge of the base element are presented for convenient removal. The disclosed embodiment is constructed so as to expose to the fingers of the user not only the upper surface of the cover element, but the lower surface of a base element enabling the box to be manipulated between the thumb and forefingers of the user, so that the box may be opened using only a single hand.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
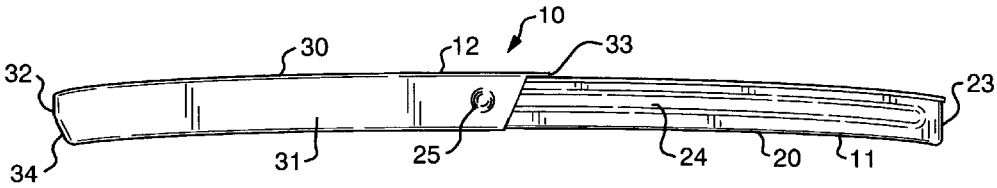
FIG. 1 is a side elevational view of an embodiment of the invention.

In accordance with the invention, the device, generally indicated by reference character 10, comprises broadly: a base element 11, and a cover element 12. Most conveniently, both elements are formed as metallic stampings, although they may also be formed by injection molding of synthetic resinous materials.

The base element 11 includes a bottom wall 20, side walls 21 and 22, and end walls, one of which is indicated by reference character 23. Each side wall includes an inwardly directed groove 24 cooperating with a corresponding detent 25 in the cover element. Both the bottom wall and the side walls are of curvate configuration to lie generally in a curved plane of relatively large radius. Where the length and width of the device is approximately three and one-half inches, the radius of the curved plane may range between eight and ten inches.

The cover element 12 is of corresponding configuration, and includes an upper wall 30, a pair of side walls 31, and end wall 32, the upper wall and side walls forming an opening 33 for introduction of the base element 11. The wall 30 includes an inwardly directed detent 34 which engages an edge of a second end wall (not shown) of the base element to maintain it in closed condition. A pair of inwardly directed detents 35 cooperate with the groove 24 to determine the limits of movement between the base and cover elements. To assure a smooth sliding action between the elements, the side walls are preferably provided with opposed elongated lips 36 to slidably engage the edge portions of the lower surface 37 of the bottom wall 20.

Figure 2:
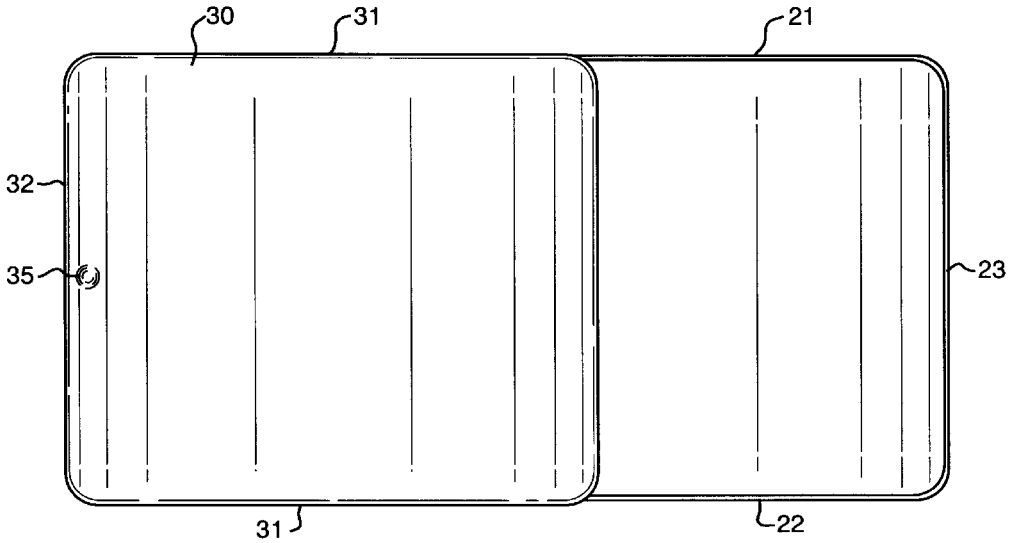
FIG. 2 is a top plan view thereof.
Figure 3:
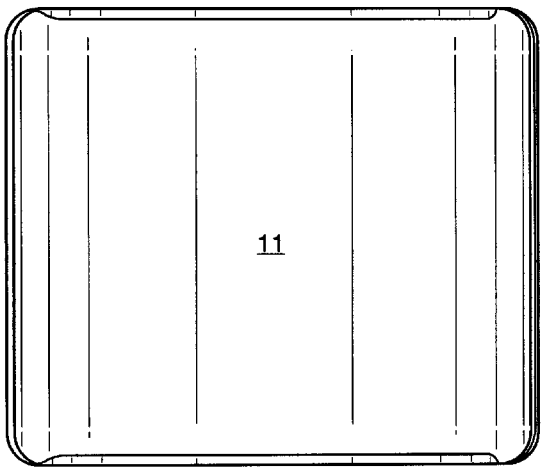
FIG. 3 is a bottom plan view thereof.

The elements may be conveniently assembled by slightly expanding the side walls 31 of the cover element and inserting the base element into the opening 33 formed therebetween. This may be accomplished whether the base element is in filled or empty condition. Once engaged, the cover element may be moved by pressing the undersurface of the bottom wall 20 and the upper surface of the wall 30 as illustrated in FIGS. 1 and 2 in the drawing.

I wish it to be understood that I do not consider the invention to be limited to the details disclosed and illustrated in the specification, for obvious modifications will occur to those skilled in the art to which the invention pertains.

I claim:

1. In a portable box for small articles including a base element and a cover element arranged for mutual sliding movement between relatively open and closed positions, said base element including a bottom wall and side and end walls, said cover element including an upper wall and a pair of side walls, said side walls defining a pair of opposed lips overlying an exposed surface of said bottom wall and adjacent a pair of side walls, to expose a centrally-exposed portion of said exposed surface for selective manual engagement thereof, the improvement comprising: each of said base element and cover element being of arcuate configuration and lying in parallel curved planes, whereby said box may be carried in a pocket garment of a user without distorting the pocket when the garment is worn.

* * * * *